United States Patent [19]

Matsui et al.

[11] Patent Number: 4,729,913

[45] Date of Patent: Mar. 8, 1988

[54] CHINCHILLA-LIKE ARTIFICIAL FUR

[75] Inventors: Masao Matsui, Takatsuki; Kazuo Okamoto, Osaka; Tsutomu Naruse; Taro Murata, both of Hofu, all of Japan

[73] Assignee: Kanebo, Ltd., Tokyo, Japan

[21] Appl. No.: 915,298

[22] Filed: Oct. 3, 1986

[30] Foreign Application Priority Data

Oct. 11, 1985 [JP] Japan ..... 60-227460
Dec. 9, 1985 [JP] Japan ..... 60-277257

[51] Int. Cl.[4] ..... A41D 5/00

[52] U.S. Cl. ..... 428/15; 428/92; 428/218

[58] Field of Search ..... 428/15, 92, 95, 218

[56] References Cited

U.S. PATENT DOCUMENTS

| | | | |
|---|---|---|---|
| 3,960,478 | 6/1976 | Pouille | 8/929 X |
| 4,241,122 | 12/1980 | Asano | 428/90 |
| 4,390,572 | 6/1983 | Okamoto et al. | 428/15 |
| 4,434,631 | 3/1984 | Matsui et al. | 118/52 X |
| 4,459,128 | 7/1984 | Matsui et al. | 8/929 X |
| 4,461,791 | 7/1984 | Matsui et al. | 428/15 |
| 4,525,404 | 6/1985 | Matsui et al. | 428/92 |
| 4,557,972 | 12/1985 | Okamoto et al. | 428/373 |
| 4,604,320 | 8/1986 | Okamoto et al. | 428/373 X |

*Primary Examiner*—Henry F. Epstein
*Attorney, Agent, or Firm*—Flynn, Thiel, Boutell & Tanis

[57] ABSTRACT

An artificial fur having chinchilla-like appearance and hand, which consists of a substrate fabric and piles provided on at least one surface thereof, which piles comprise underhairs of 0.5 to less than 4.0 deniers, having an average length of 10~35 mm, a hair density of 8,000~30,000 hairs/cm$^2$, a crimp ratio of at most 20%, a frictional coefficient in the right direction of 1.6 or less and a frictional coefficient ratio of the adverse direction to the right direction of 1.0~1.4. The piles preferably further comprise guard hairs of 4~50 deniers, equal to or a little longer than underhairs, having a hair density of 3,000 hairs/cm$^2$ or less. The piles preferably have color variations lengthwise.

14 Claims, 21 Drawing Figures

CHINCHILLA-LIKE ARTIFICIAL FUR

BACKGROUND OF THE INVENTION

1. Field of the Invention

This invention relates to a high-grade artificial fur and particularly to an artificial fur having an excellent appearance and feel or hand similar to that of a chinchilla fur.

2. Related Art Statement

Natural furs have an extremely delicate, precise structure and also have excellent appearance and feel. A large number of attempts for producing high-grade artificial furs that can match natural furs have been made, but satisfactory products have not yet been obtained. The present inventors have already proposed highly advanced methods for processing piles and resulted products in U.S. Pat. Nos. 4,459,128; 4,461,791; and 4,525,404.

SUMMARY OF THE INVENTION

Among natural furs, a chinchilla has a unique appearance and feel or hand, and is appreciated as an article of the highest quality. A high-grade artificial fur which can match chinchilla is so difficult to manufacture that satisfactory articles have not yet been commercially produced.

An object of the present invention is to provide an artificial furs having a high grade of appearance and feel comparable to that of natural chinchillas.

An artificial fur according to the present invention is characterized in that (a) piles comprising underhairs having a fineness ranging from 0.5 to less than 4.0 deniers, an average length ranging from 10 to 35 mm, a hair density ranging from 8,000 to 30,000 hairs/cm$^2$ and a crimp ratio of 20% or less, are provided on at least one surface of a substrate fabric, (b) said piles have a frictional coefficient in the right direction of 1.6 or less, and (c) a ratio ($M_2/M_1$) of a frictional coefficient in the adverse direction ($M_2$) to that in the right direction ($M_1$) of the piles ranges from 1.0 to 1.4.

Besides, in an embodiment of an improved artificial fur according to the present invention, the piles further comprise guard hairs having a fineness ranging from 4 to 50 deniers and a hair density of at most 3,000 hairs/cm$^2$. A difference in average length between the guard hairs and the underhairs ranges from 0 to 7 mm and a weight per unit area of parts exposed above underhairs of the guard hairs ranges from 0 to 20 mg/cm$^2$.

DESCRIPTION OF THE PREFERRED EMBODIMENTS

The present invention will be explained with reference to the attached drawings hereinafter.

Figure 1:
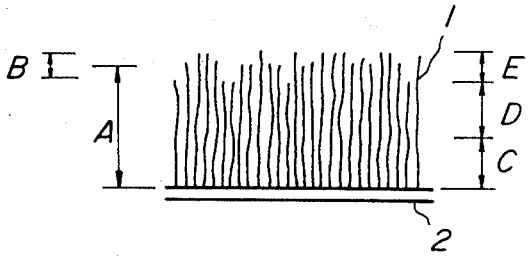
FIG. 1 is an illustrative schematic view showing a typical embodiment of a structure of artificial fur according to the present invention.

In FIG. 1, the numeral 1 is an underhair and the numeral 2 is a substrate fabric. Substrate fabric 2 can be selected from knitted, woven, nonwoven and the like fabrics. Suitable fabrics are dense, soft and light-weight woven fabrics, for example, fabrics having a weight per square meter of 200 g or less, particularly 50–150 g. Of course, the fabric may contain an adhesive, such as a polyurethane resin or the like, for fixing or stabilizing piles or texture.

Figure 2:
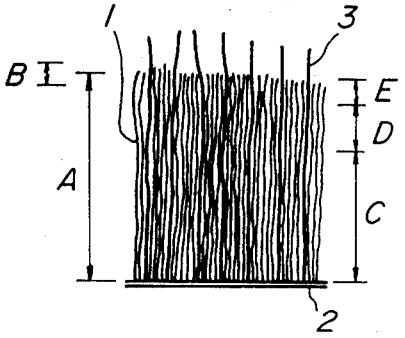
FIG. 2 is an illustrative schematic view showing another embodiment of a structure of artificial fur according to the present invention.

In FIG. 2, which shows a further embodiment of an improved artificial fur according to the present invention, the numeral 3 shows a guard hair which is thicker and generally a little longer than underhairs. Without using these guard hairs, the hand characteristic of chinchilla can be provided and, however, as can be readily understood from the fact that a natural chinchilla has a small number of guard hairs, existence of guard hairs having an appropriate fineness, with the proper hair density and degree of exposure, provides the fur article with preferable bulkiness, resiliency and hair-loosening ability as well as delicate variations in appearance.

Piles which compose the artificial fur of the present invention will be explained in more detail hereinafter.

The fineness of underhair 1 should be from 0.5 denier to less than 4.0 deniers, preferably 0.7 to 3.0 deniers, more preferably 0.9 to 3.0 deniers, and most preferably 0.9 to 2.5 deniers. That is because, when underhairs are too thin, the resultant fur will be lacking in bulkiness, and when too thick, it will become undesirably stiff. The hair density of underhairs must range from 8,000 to 30,000 hairs/cm$^2$, preferably 10,000 to 22,000 hairs/cm$^2$, and most preferably 12,000 to 20,000 hairs/cm$^2$. When the density is too low, the fur will be deficient in bulkiness, and when too high, it will be poor in the softness and light weight properties desired.

An average length of the underhairs 1 should range from 10 to 35 mm, particularly 12 to 30 mm, and most preferably 15 to 25 mm. Although all of the underhairs may not necessarily have a completely uniform length, it is preferred that the underhairs have an almost uniform length. As a matter of fact, it is very difficult to make the length of underhairs uniform over the whole surface of a broad pile fabric and it is not necessary. It is often preferable that a variety is given to the appearance of the fur by distributing the length of the underhairs or by more or less varying (for example, about ±30%), from place to place, the average length of underhairs. However, it is desirable that the underhairs have a substantially uniform length locally (for example, within a square region 1 cm wide and 1 cm long on the substrate fabric).

In FIG. 1, the average length of the underhairs 1 is shown by A and the range of variation in the length of the underhairs is shown by B. FIG. 1 shows an example having a B/A of a 0.2 (20%), that is, of considerably high uniformity. FIG. 2 shows another example of a 0.1 (10%) B/A, having an extremely high uniformity. Generally, viewing locally, it is preferred that 70% or more (in number) of the underhairs have a length within ±30% of the average length A (A±0.3 A); more preferably, 80% or more of the underhairs have a length within ±20% of the average length; and most preferably, 80% or more of the underhairs have a length within ±10% of the average length. It is also preferred that a local uniformity of piles is maintained over a broad area of the fabric, for instance, 60% or more, particularly 70% or more, of its surface area, and such a case is herein referred to as "underhairs have a substantially uniform length".

Figure 3:
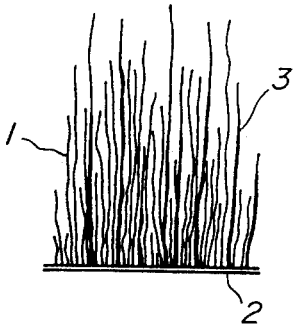
FIG. 3 is an illustrative schematic view showing an example of a structure of a conventional artificial fur.

FIG. 3 shows an example of conventional artificial furs of low quality, such as a pile article obtained from a spun yarn of staple fibers or a product provided by means of a silver knitting machine, etc. Piles of such a product essentially do not have a uniform length. In the example shown in FIG. 3, the hair density near the substrate fabric is high while that in the upper layer is low, so the appearance is poor and different from the plentiful underhairs of chinchillas. Furthermore, short piles are prone to tangle in longer piles, thereby hindering movements of piles and impairing the loosening ability (movability) of the piles, so that the variety of appearance characteristic of chinchillas, caused by the swaying of the piles because of a breeze or the wearer's movements, can not be obtained.

A product provided with piles having a uniform length and an attenuated top end has been made manufacturable by a process disclosed by the present inventors in U.S. Pat. No. 4,459,128 wherein a centrifugal force is utilized. Similarly, in accordance with this process, it is possible to attenuate the top end of the piles with an appreciably high uniformity. The attenuated portion has a length of preferably 4 mm or less and more preferably 0.5~3 mm. Further, the attenuated portion may have either a gradually tapered form or stepwise decreased diameters towards the tip, or even may be nothing more than a round tip, to effectively prevent the piles from interlacing or intertangling a impart a aesthetic effect to the appearance as compared with piles cut mechanically with a blade.

Figure 4:
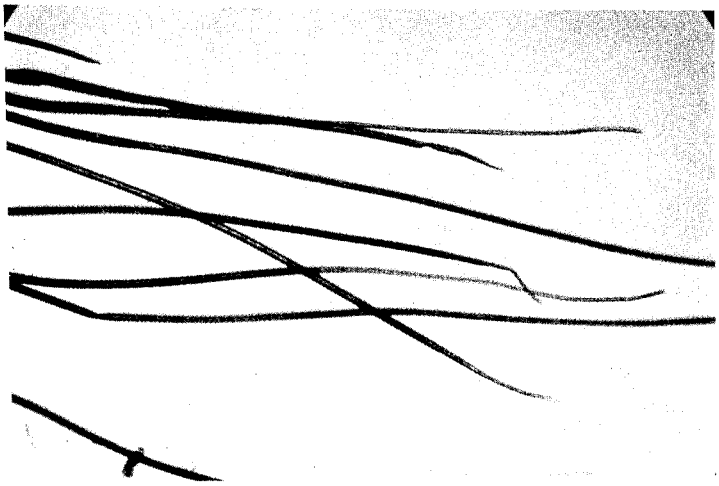
FIG. 4 is a photomicrograph of a top end portion of piles provided on an artificial fur according to the present invention.

FIG. 4 is a photomicrograph which shows in an enlarged scale an attenuated top end portion of the piles of an artificial fur according to the present invention. The piles must have a slight crimp. Piles having no crimp look poor, while too intense a crimp makes piles intertangle whereby a hair-loosening ability of the piles will be lost. A crimp ratio is necessarily 20% or less, preferably 10% or less, and most preferably in the range between 0.5 and 5%. The crimp ratio is determined in an ambient room at 22° C. with 65% RH and calculated by the following equation (I):

$$\text{Crimp ratio} = \frac{l - l_0}{l} \times 100 \qquad \text{(I)}$$

where, $l_0$: The length of sample (mm) 2 minutes after a load of 2 mg/d was applied, and l: The length of sample (mm) 2 minutes after a load of 50 mg/d was applied.

In the case where the sample is underhairs cut out from a pile article, a bundle of about 50 deniers is formed, using the longest underhairs possible, and a mean value is obtained from 20 measurements. When the sample is sufficiently long, a bundle of about 1,000 deniers and 30 cm long is formed and measured.

In order to provide a slight crimp as mentioned above, it is necessary to control a crimpability of raw fibers at their manufacturing stage. The crimp can be provided to the fibers by means of false-twisting, stuffing box, conjugate-spinning, etc. A slight crimp can be obtained by selecting, in a process for providing a crimp, such conditions that the crimp development may be sufficiently controlled. For instance, in the case of flase-twisting, the smaller the number of the twist and the lower the heater temperature, the more restrained the crimp development. Further, after once having been false-twisted, the crimp can be restrained by heat-treatment under tension, and in this case, the larger the tension and the higher the temperature, the more restrained is the crimping. In the case of the stuff-in-box process, the lower the stuffing pressure and, also, the lower the setting temperature, the more restrained the crimping. It is similar to the case of false-twisting in that the crimp can be further restrained, after crimping, by heat-treatment under tension. A heat-set for restraining crimps also can be effected during weaving processes. For instance, pile yarns can be heat-treated between a beam and a reed or a woven double pile fabric can be heat-treated before the piles are cut. In the case of conjugate spinning, the smaller the difference in heat-shrinkability between two components and the lower the eccentricity in conjugation, the more restrained the crimping. Before using raw fibers for fabricating pile articles, it is preferred to select conditions for manufacturing these raw fibers so that a crimp ratio of 20% or less, particularly 1~10%, may be provided to a bundle of, for example, 1,000 deniers which is formed from the raw fibers and treated under a tensionless condition for 10 minutes in boiling water and air-dried. It is discretionary whether use underhairs comprising a mixture of two or more kinds of fibers differing in polymer, dyeability, color, luster, fineness, cross-section, crimpiness, etc.

Products of a more preferable type, according to the present invention, have guard hairs which are thicker and preferably a little longer than underhairs. As mentioned hereinabove, existence of guard hairs having an appropriate fineness, with proper hair density and degree of exposure, provides a fur article with the preferably bulkiness, resiliency, frictional coefficient, feel, hair-loosening ability as well as delicate variations in appearance. The guard hairs have preferably an attenuated top end portion and a fineness of 4~50 deniers, particularly 5~30 deniers, and most preferably 8~20 deniers. However, when the guard hairs are of 20 deniers or less, particularly 10 deniers or less, there may be the case that the aesthetic appearance and feel or hand are not substantially married, even if the top end portion is not attenuated.

Figure 5:
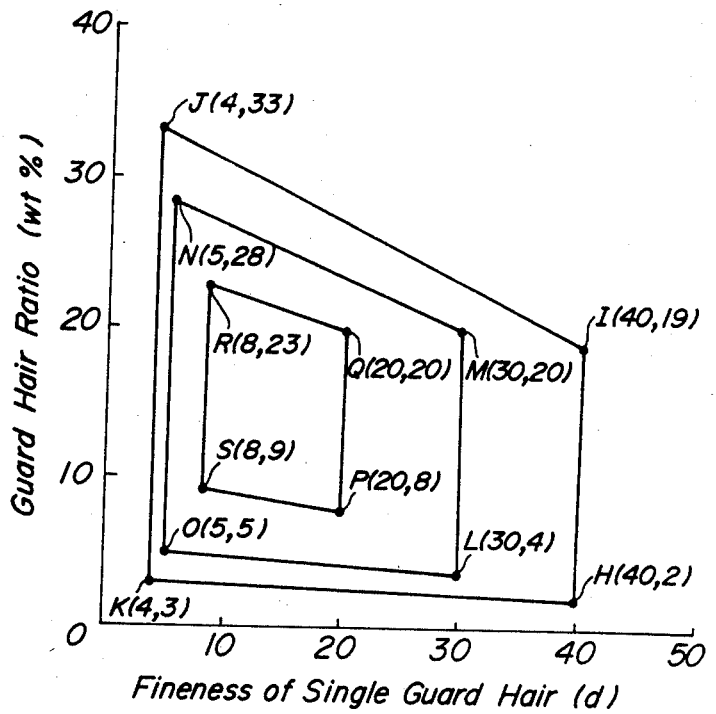
FIG. 5 is a relative diagram showing areas, each defines a preferred relationship between fineness of individual guard hairs and a weight ratio of guard hairs to piles.

The hair density of the guard hairs preferably ranges from 30 and 3,000 hairs/cm$^2$, particularly 50 to 1,000 hairs/cm$^2$, and most preferably 100 to 500 hairs/cm$^2$. For fine hairs as fine as, e.g., 5~10 deniers individually, the hair density may be high, e.g., 300~3,000 hairs/cm$^2$; for medium hairs of 10~20 deniers, the hair density may be also medium, e.g., 100~1,000 hairs/cm$^2$; and for thick hairs as thick as 20~50 deniers, the preferred hair density is low, e.g., 50~500 hairs/cm$^2$. Similarly, it is preferred that the thicker the guard hairs, the smaller the corresponding weight ratio of guard hairs to total piles. FIG. 5 shows preferred areas for the fine individual guard hairs and the weight ratio of guard hairs to piles. In the figure, quadrilateral HIJK defines a preferred area, quadrilateral LMNO defines a particularly preferred area, and quadrilateral PQRS defines a most preferred area. Respective coordinates are as follows:

H(40,2), I(40,19), J(4,33), K(4,3),
L(30,3), M(30,20), N(5,28), O(5,5),
P(20,8), Q(20,20), R(8,23), S(8,9).

When the guard hairs consist of a plurality of fibers each differing in fineness from the others, the fineness of the guard hairs is represented by an averaged fineness. Namely, from the total weight and total length of guard hairs (of 4 deniers or more), a weight (g) per 9,000 m is obtained and the resulted value represents the fineness (in denier).

Guard hairs should not be too much longer than the underhairs, that is, they should not be too conspicuous. The difference in the average length between guard hairs and underhairs preferably range from 0 to 7 mm, and most preferably from 1 to 6 mm. Similarly, a weight per unit area of the parts exposed above the underhairs (mean length of underhairs) of the guard hairs is preferably 20 mg/cm$^2$ or less, more preferably 0.2–10 mg/cm$^2$, and most preferably 0.5–5 mg/cm$^2$. If it is too heavy, for instance, 20 mg/cm$^2$ or more, particularly in excess of 25 mg/cm$^2$, the resulting article becomes as stiff as a mink and the object of the present invention is not attained. Namely, in the article according to this invention, the guard hairs have such a length that they may be hardly or slightly observable. However, it has been found that guard hairs having such a small degree of exposure not only provide delicate variations to appearance, but also have an unexpectedly very large effect on improving the bulkiness, resiliency, hair-loosening ability, frictional coefficient, etc. of the piles. It is preferred that the guard hairs have essentially no crimp, but those having a crimpiness of 10% or less, particularly a small crimpiness of 5% or less, are also utilizable.

Piles of the article of the present invention are characterized by exhibiting a small frictional coefficient and little property difference dependent to directions (i.e., low anisotropic). The piles thereby sway freely in any directions with a breeze or movements of the wearer's body, or when touched by a hand, so that variety of appearance as well as a soft and comfortable feel characteristic of chinchillas is provided. For the above qualities, the piles have a frictional coefficient in the right direction of 1.6 or less, preferably 1.4 or less, and most preferably 1.2 or less. The term "right direction" used herein means the direction to which piles incline, wherein the frictional coefficient is minimal. The direction making an angle of 180° with the right direction is referred to as an adverse direction. The ratio ($M_2/M_1$: hereinafter referred to as "adverse/right ratio") of a frictional coefficient in the adverse direction ($M_2$) to a frictional coefficient in the right direction ($M_1$) ranges from 1 to 1.4, preferably from 1 to 1.3, and most preferably from 1 to 1.2. The larger the adverse/right ratio of the frictional coefficient is, the more the anisotropy of piles, for example, minks generally have that of 2 or more. Accordingly, as the adverse/right ratio approaches 1, the piles become isotropic. For example, a certain chinchilla exhibits about 1.1. In fact, an adverse/right ratio of not more than 1.4 can provide chinchilla-like features.

Figure 6:
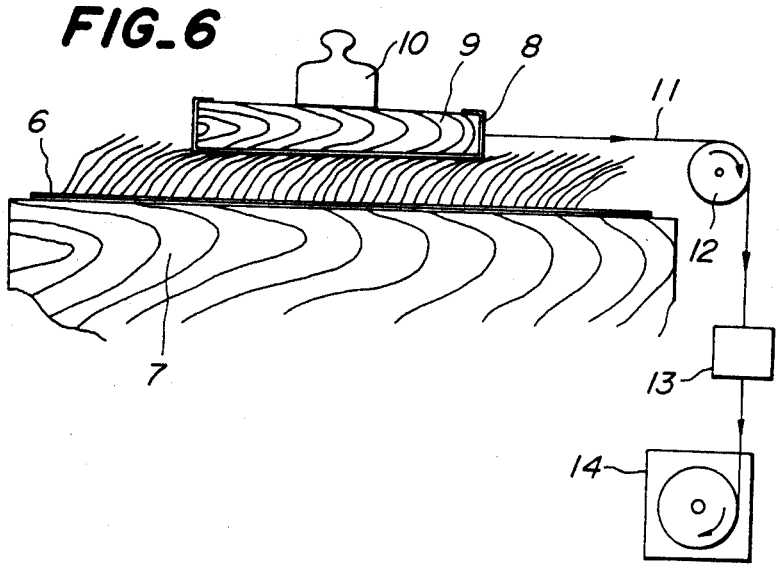
FIG. 6 is an illustrative elevational view showing a method for measuring a frictional coefficient of fur.

A mixture of determining a frictional coefficient is shown in FIG. 6. A sample of artificial fur 6 is fixed on a horizontal base 7, on which is placed a friction board 9 provided with a friction cloth 8 fixed on its bottom surface. The friction board is 5 cm wide and 10 cm long, and the friction cloth, clean cotton cloth (Cannequin #3) in accordance with JIS-L0803, well washed, is used. On the friction board 9, an adequate weight 10 is placed to adjust the total load to 150 g, in such a manner that the load is applied equipollently over the sample. The friction board is drawn by a string 11 towards the direction indicated by the arrow at a speed of 10 cm/min. and the tension of the string is read on a tensiometer 13. Numeral 12 indicates a pulley and numeral 14 a motor for winding up the string. A frictional coefficient is given by the following equation (II):

$$\text{Frictional coefficient} = \frac{\text{Force of drawing}}{\text{Load}} = \frac{\text{Tension of string}}{150} \quad \text{(II)}$$

In FIG. 6, an example for measuring a frictional coefficient in the right direction of piles is shown, and if the sample if fixed adversely, a frictional coefficient in the adverse direction is measured. When the right direction is not recognizable clearly by appearances, the direction wherein a frictional coefficient is minimized among various directions (e.g. eight directions) is regarded as the right direction. The sample is washed with a detergent for home use, e.g., "Shin New-Beeds TM" supplied by Kao Soap K.K., rinsed well to thoroughly remove the detergent and air-dried before measuring. When it is difficult to wash with water, a dry cleaning will do, but in the last stage, a sufficient rinsing with a cleaning liquid free from active agent or detergent is required so that any detergents or surfactants in the cleaning liquid may not remain in the sample. At any rate, since a measured value of frictional coefficient may deviate from the true value, if oils, surfactants or the like remain on the surface of piles, it is necessary to remove thoroughly those stains before measuring. The ambient atmosphere during measurement is kept at 22° C. and 65% R.H.

As a tensiometer, an electric transducer, such as a wire resistance strain gauge, semiconductor strain gauge and the like, is suitable, with which a strain is measured and recorded on a recorder, etc. and use may be made of, for example, a mean value in the period from 30 to 60 seconds after the commencement of the measurement (the movement of the friction board). A sample which has been left standing in the measuring atmosphere for 24 hours is used. It is preferred that measurements in the right and the adverse directions be carried out using different samples respectively (in order to avoid influence of the previous measurement). In the case where the same sample is measured, the measurement in the right direction precedes and then, after the sample has been left standing in the measuring room for 24 hours, the measurement in the adverse direction is carried out.

As mentioned above, one of the most important features of chinchilla-like pile articles is that the frictional coefficient of piles is substantially isotropic or less anisotropic. Such a characteristic can be realized by synthetically effecting:

(A) forming the piles into a structure as isotropic as possible, namely, into nearly an upright figure;

(B) lowering the frictional coefficient of the piles by an appropriate method;

(c) preventing the interlacing or intertangling of piles to enhance hair-loosening ability, particularly restraining the crimping of underhairs; and (D) essentially uniformizing the length of piles.

The frictional coefficient of the pile fibers can be lowered by (a) blending or copolymerizing a lubricating agent with a component polymer, such as a polyester, and/or (b) forming on the surfaces of the piles a smooth resin membrane (preferably having superior durabilities for laundering and dry cleaning) by a post-finishing process, etc. As a lubricating agent to be blended or copolymerized with the polymer, mention may be made of those having an alkyl, polyalkylene ether, organosiloxane or fluoroalkyl group, other silicone- or fluoro-groups or compounds, and the like. Examples include mineral oils, animal or vegetable paraffins, synthetic paraffins, polyethylene, polybutene, copolyolefins, polyethyleneoxide, polypropyleneoxide, polybutyleneoxide, copolyethers, fatty acids, the esters or metal salts thereof, higher alcohols and esters thereof, animal or vegetable oils and fats, synthetic oils and fats such as alkyl benzene, polyalkyl diphenyl and the like, silicone oils such as polyorganosiloxane and the like, fluoroethylene polymers or copolymers and vinyl compounds or polymers having a fluoroalkyl group and the like. Preferred are fibers having their frictional coefficient lowered to 80% or less, particularly 70% or less, as compared with unmodified fibers, by blending or copolymerizing, for instance, 0.01~10%, particularly 0.1~5%, of a lubricating agent. The frictional coefficient of, for example, polyethyleneterephthalate (hereinafter referred to as PET) or polybutyleneterephthalate (hereinafter referred to as PBT) fibers, is determined to be about 0.35~0.45, when measured by passing a yarn thereof at a speed of 300 m/min. over an aventurine hard chrome-plated rod (having a roughness of 1.5 S), with a yarn contact angle of 180°, and it can be lowered to about 0.20~0.35, or less, by incorporating a lubricating agent.

Materials for pile fibers can be selected discretionally from any polymers for organic fibers such as polyamides, polyolefins, polyesters, polyvinyls and the like. Among others, polyesters are easy to attenuate the top end portion with an alkaline aqueous solution, so that, for example, PET, PBT and copolymers thereof are preferred. As a copolymeric component therefor, polyalkylene-oxides, sulfone-group containing compounds such as sulfo-isophthalic acid and the like, are generally used for improving the dyeability or decomposability by alkalis. Other than those, materials for polyesters, such as any glycols, dicarboxylic acids, hydroxyl carboxylic acids and the like, can be utilized.

Figure 7:
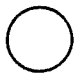
FIGS. 7–17 are embodiments of cross-section of fibers employable for piles of the artificial furs according to the present invention.
Figure 10:
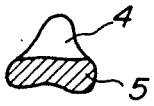
Figure 11:
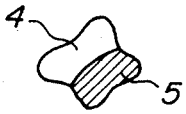
Figure 12:
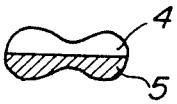

Pile fibers may have any cross-sectional configuration. It may be either circular or non-circular. In FIGS. 7–17, are shown examples of a cross-section of fibers suitable for underhairs or guard hairs in the present invention. FIG. 7 shows a circular shape, FIG. 8 an oval shape, and FIGS. 9–17 show various non-circular shapes. For underhairs, those having an irregularity as shown in FIGS. 9–17, which make underhairs difficult to cohere, are preferably used, whereby the underhairs will be prevented from intertangling and improve thermal insulation as well as bulkiness. In order to provide a spontaneous crimpability, underhairs may comprise composite filaments, each consisting of a plurality of components, different in heat- or swelling-shrinkability, bonded side by side with each others. FIGS. 10–12 show examples of composite filament which consists of two components 4 and 5.

Figure 17:
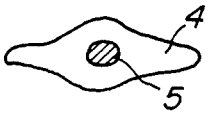
Figure 18:
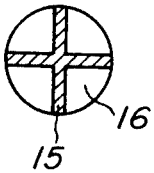
FIGS. 18–21 are cross-sections of embodiments of separable composite filaments suitable for substrate fabrics of the artificial furs according to the present invention.

FIG. 17 is an embodiment of a wing-like cross-section of a sheath-core type composite filament suitable for guard hairs. At least one of filaments having a cross-section as shown in FIGS. 7–16 can be utilized as guard hairs.

Piles may have any color desired. However, it is necessary, for realizing color variations with the movement of piles which are characteristic of chinchillas, that pile portions having different colors are exposed when the piles move or sway randomly, and so it is preferred that upper (top) and lower portions of piles are different in color. In FIGS. 1 and 2, the lower portion is shown by C, the middle portion by D and the surface portion by E. Most chinchillas have a complexion of an intricate mixture of, e.g., regions wherein the lower and middle layers are grey in a middle shade and the surface layer is either light grey to white or contrarily black to dark brown and regions wherein the middle layer is light grey to white and the surface layer is black to dark brown, etc. Such a three-dimensional coloring can be readily performed according to the aforementioned process disclosed by the present inventors wherein a centrifugal force is utilized. In natural fur articles, the length, shape, color, etc. of piles are limited, whereas in artificial articles, those can be selected discretionally so that artificial products having excellent, high fashionable, aesthetic properties and artistic effects which are not possessed by natural articles, are obtained.

Even when the piles have been formed into a perfectly upright figure, they will be disordered to a certain degree and some change of the surface condition will thereby be caused during transportation or storage prior to use, or during wearing. However, such a figure can be stabilized by making the piles incline or bend slightly or transform regularly or irregularly towards various directions, preferably maintaining a natural impression, followed by heat-setting, etc. during manufacturing processes. For this purpose, piles can be disarranged by a mechanical means such as an adequate crumpling or rubbing machine, or by utilizing a process for spraying a gas or liquid. However, since anisotropicity of frictional coefficient will be increased, making all piles incline entirely towards a same direction (as most of conventional artificial furs) is not preferable.

In order to provide effective variations in appearance, particularly color or apparent variations with three-dimensional movements of piles, the substrate fabric is required to have a high softness. A substrate fabric may be measured, i.e., a plain fabric which is prepared from a fur by trimming its piles at their root as close as possible, in accordance with JIS L-1096 (45° Cantilever Method for Stiffness). In general, the stiffness of the substrate fabric (the moving distance of the specimen when its end reaches the slope of cantilever) is preferably 60 mm or less both in the warp and weft directions, particularly preferably 40 mm or less, and most preferably 30 mm or less. Such soft substrate fabrics are obtained by using yarns composed of filaments of fine denier for a part of all of the warp (ground) and weft (ground) yarns. In order to provide a substrate fabric with an excellent softness, the fineness of the individual filaments composing the ground yarns for the substrate fabric is preferably 3 deniers or less, more preferably 1.5 deniers or less, and most preferably 1 denier or less. A super fine yarn whose individual filaments are about 1.2 deniers or less and an ultra-super fine yarn whose filaments are about 0.5 denier or less are particularly suitable. The ultra-super fine yarn can be obtained by splitting, by a chemical or physical means, splittable multi-layered filaments having a cross-section of side by side, grain-like, radial, annular and radial, multi-core, mosaic, archipelagian or the like (refer to J. Tex. Mach. Soc. Japan, 34, No. 7, p.315-p.325).

In FIGS. 18–21, embodiments of cross-sections of splittable composite filament are shown. The splitting may be effected either in the form of yarn or after weaving. As ground yarns, discretionally employed are nylon, polyester, acrylic, their composite yarns, etc. Needless to say, splittable filaments used as piles also can be split after forming piles.

As an adhesive resin to be applied to the substrate fabrics, suitable are, for example, polyurethane elastomers, silicone resins, acrylic resins and the like, which are as soft as possible. The add-on of resin is preferred to be as small as possible, in respect to softness and lightness in weight, which is usually at most 30% by weight of fabric, particularly preferable when at most 20%, and most preferably 3~15% by weight. Further, for increasing the softness of a substrate fabric, it is preferred to form interstices between the resin and ground yarns, by sizing appropriately the ground yarns in advance, applying an adhesive resin upon the sized yarns and then designing, etc.

The present invention will be described in more detail by way of examples hereinafter. Percent, part, etc. used herein are by weight unless otherwise specified.

EXAMPLE 1

Figure 9:
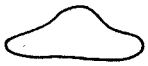

PET having a molecular weight of 15,000 and containing 1.2% of titanium dioxide (dulling agent) was melt-spun to produce a drawn filament yarn $WF_1$ of 75 d/60 f having a cross-section as shown in FIG. 9. A crimp of about 8% crimp ratio was provided to this drawn filament yarn by the Banlon® process.

When a cut-pile fabric was woven on a double-pile loom, using, as warp and weft yarns (ground yarns), 60 count two-ply yarn which consisted of crimped PET staples of 1.5 d having a cut length of 38 mm and using, as pile yarn, the above-mentioned crimped filament yarn, ply number of yarn $WF_1$ and piling density in the pile fabric were varied to obtain six kinds of cut pile fabrics CP1~6, given in Table 1 below.

TABLE 1

| Fabric | Pile yarn (d/f//ply) | Piling density (piles/cm$^2$) | Hair density (hairs/cm$^2$) | Cut pile length (mm) |
|---|---|---|---|---|
| CP1 | 75/60 | 105 | 6,300 | 40 |
| CP2 | 75/60//2 | 75 | 9,000 | " |
| CP3 | " | 105 | 12,600 | " |
| CP4 | 75/60//3 | " | 18,900 | " |
| CP5 | " | 130 | 23,400 | " |
| CP6 | 75/60//4 | " | 31,200 | " |

The above-mentioned six kinds of pile fabrics were respectively finished in accordance with the process disclosed by the present inventors in U.S. Pat. No. 4,459,128 wherein a centrifugal force was utilized. Namely, the respective fabrics CP1~CP6 were finished by rotating the fabric fixed on a rotary cylinder having a diameter of 1 m to raise the piles by centrifugal force and feeding a treating liquid into an outer container, (outer cylinder) having a diameter of 1.1 m, rotating coaxially at the same speed with said rotary cylinder. At the outset, the pile fabric was heat-set at a temperature of 170° C. with a rotation speed of 300 rpm (a centrifugal force of about 50 G), and as a treating liquid, 18% NaOH aqueous solution at 97° C. was fed up to an inside liquid level from substrate fabric of 27 mm, which was then gradually discharged by 1 mm from said level over a period of 25 minutes, to cut pile yarns into a length of 28 mm. After discharging all the caustic solution rapidly, the thus alkali weight-reduction treated fabrics CP1~CP6 were washed with water, dried and taken out of the centrifugal finishing machine. The piles had a substantially uniform length of 27~28 mm.

For finishing, an aqueous emulsion of polyurethane elastomer (prepolymer) was applied by spraying the back of the substrate fabrics; a softening agent, SOFBON TM ST-212/SOFBON TM ST-206=50/50 (manufactured by Takemoto Yushi K.K.), was applied by spraying upon the piles with an add-on amount as pure ingredients of 0.5%; then the fabrics were subjected to a dry heat-treatment at 180° C. to cure those resins, followed by drying; and thus artificial furs AF1~AF6 were obtained. Their properties are shown in Table 2 below.

TABLE 2

| Art. fur No. | Pile fabric No. | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness | Stillness of substrate fabric (mm): Warp | Stillness of substrate fabric (mm): Weft |
|---|---|---|---|---|---|---|---|---|---|
| AF1 | CP1 | 1.28 | 1.34 | 1.05 | | | X | 42 | 39 |
| AF2 | CP2 | 1.30 | 1.36 | 1.05 | | | | 42 | 39 |
| AF3 | CP3 | 1.30 | 1.40 | 1.08 | | | | 42 | 39 |
| AF4 | CP4 | 1.38 | 1.45 | 1.05 | | | | 42 | 39 |
| AF5 | CP5 | 1.47 | 1.53 | 1.04 | | | | 42 | 39 |
| AF6 | CP6 | 1.72 | 1.80 | 1.05 | X | X | | 42 | 39 |

Note:
Very good, Good, Δ A little inferior, X Inferior.

From the above result, it has been demonstrated that if hair density is too low, bulkiness is inferior, and if hair density is too high, softness and hair loosening ability are lowered, while frictional coefficient is increased.

EXAMPLE 2

Figure 19:
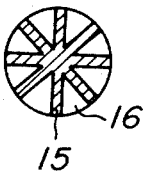
Figure 20:
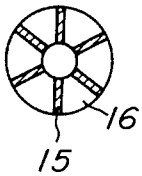
Figure 21:
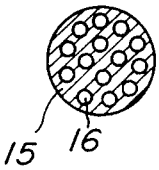

PET having a molecular weight of 17,000 and containing 1.2% of titanium dioxide was melt-spun to produce drawn yarns of 75 d/16 f, 75 d/20 f, 75 d/36 f and 75 d/60 f, having a cross-section as shown in FIG. 9. Further, using the above-mentioned PET and a copolymer of PET with 18% of polyethyleneglycol (hereinafter referred to as PEG) having a molecular weight of 600, which copolymer having a molecular weight of 17,000 and containing no titanium dioxide, a conjugate-spinning was carried out to obtain composite filament yarns of 100 d/18 f and 100 d/36 f, individual filaments of which had a cross-section as shown in FIG. 19. In FIG. 19, numeral 15 denotes the PET copolymer and numeral 16 PET, and the conjugate ratio of PET copolymer to PET is $\frac{1}{3}$.

The Balon® process was effected on these filament yarns so as to result in a crimp ratio of 8%. Using thus obtained crimped filament yarn as pile yarn and the same ground yarns as used in Example 1, cut-pile fabrics CP7~12 shown in Table 3 were woven on a double-pile loom.

TABLE 3

| Fabric | Pile yarn (d/f//ply) | Piling density (piles/cm$^2$) | Hair density (hairs/cm$^2$) | Cut pile length (mm) |
|---|---|---|---|---|
| CP7 | 75/16//3 | 175 | 8,400 | 30 |
| CP8 | 75/20//3 | 150 | 9,000 | 30 |
| CP9 | 75/36//3 | 84 | 9,072 | 30 |
| CP10 | 75/60//3 | 150 | 27,000 | 30 |
| CP11 | comp. 100/18//2 | 92 | 3,312 | 30 |
| CP12 | comp. 100/36//1 | 92 | 3,312 | 30 |

Before finishing, the fabrics CP11 and CP12 were soaked in 1% NaOH aqueous solution at 90° C. for 60 minutes, in advance, to elute the PET copolymer component from composite filaments, thereby thinning down the filaments, then washed with water and dried. Then those six kinds of pile fabrics were finished in the same manner as Example 1 and artificial furs AF7~AF12 were obtained. Their structure and properties are shown in Table 4 below.

TABLE 4

| Art. fur No. | Pile fabric No. | Piles: Filament count (denier) | Piles: Hair density (hairs/cm$^2$) | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness |
|---|---|---|---|---|---|---|---|---|---|
| AF7 | CP7 | 4.69 | 8,400 | 1.31 | 1.39 | 1.06 | X | | |
| AF8 | CP8 | 3.75 | 9,000 | 1.30 | 1.40 | 1.08 | Δ | | |
| AF9 | CP9 | 2.08 | 9,072 | 1.34 | 1.45 | 1.08 | | | |
| AF10 | CP10 | 1.25 | 27,000 | 1.50 | 1.56 | 1.04 | | | |
| AF11 | CP11 | 0.52 | 26,496 | 1.58 | 1.68 | 1.06 | | Δ | |
| AF12 | CP12 | 0.26 | " | 1.82 | 1.99 | 1.09 | | X | X |

From the above result, it has been demonstrated that a preferable filament count (fineness of individual filaments) of piles is from 0.5 denier to less than 4 deniers.

EXAMPLE 3

Using cut pile fabric CP4 used in Example 1, the centrifugal finishing was effected. In this case, the finishing was carried out in the same manner as Example 1 except that the cut length of pile yarns was varied, and artificial furs AF13~AF18 were obtained. Their structure and properties are given in Table 5 below.

TABLE 5

| Art. fur No. | Piles: Filament count (denier) | Piles: Hair density (hairs/cm$^2$) | Piles: Pile Length (mm) | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness |
|---|---|---|---|---|---|---|---|---|---|
| AF13 | 1.25 | 18,900 | 7 | 1.35 | 1.38 | 1.02 | Δ | | X |
| AF14 | " | " | 10 | 1.35 | 1.42 | 1.05 | | | Δ |
| AF15 | " | " | 15 | 1.36 | 1.42 | 1.04 | | | |
| AF16 | " | " | 25 | 1.38 | 1.43 | 1.04 | | | |
| AF17 | " | " | 35 | 1.54 | 1.66 | 1.08 | | Δ | |
| AF18 | " | " | 38 | 1.65 | 1.77 | 1.07 | | X | |

From the above result, it has been found that a pile length of 10–35 mm is desirable.

EXAMPLE 4

During Banlon® processing of the drawn filament yarn of 75 d/60 f used in Example 1, the heat-set temperature was varied to produce 3 kinds of crimped filament yarns differing in crimp ratio. From these yarns, respective three-ply yarns were prepared, and using them as pile yarns, cut pile fabrics were woven in the same manner as fabric CP4 in Example 1, which were then finished also in the same manner, to provide artificial furs AF19~AF21. Their structure and properties are given in Table 6 below.

TABLE 6

| Art. fur No. | Crimp ratio of pile yarn (%) | Piles: Filament count (denier) | Piles: Hair density (hairs/cm$^2$) | Piles: Pile length (mm) | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness |
|---|---|---|---|---|---|---|---|---|---|---|
| AF19 | 25 | 1.25 | 18,900 | 28 | 1.77 | 1.84 | 1.04 | Δ | X | |
| AF20 | 18 | " | " | " | 1.55 | 1.69 | 1.09 | | Δ | |
| AF21 | 10 | " | " | " | 1.40 | 1.46 | 1.04 | | | |

EXAMPLE 5

When cut pile fabric CP4 used in Example 1 was treated by the same centrifugal finishing process as Example 1, the 18% NaOH aqueous solution was fed up to inside liquid levels from a substrate fabric of 10 mm, 16 mm, 22 mm and 27 mm respectively, which was then discharged at a constant rate over a period of 25 minutes until the liquid level reached 28 mm, whereat the pile yarns were cut, and thus 4 kinds of treated fabrics were obtained. The subsequent treatment thereafter was carried out in the same manner as Example 1 and artificial furs AF22~AF25 were produced. Their structure and properties are shown in Table 7 below.

TABLE 7

| Art. fur No. | Piles: Average pile length (mm) | Piles: Rate of variation (%) | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness |
|---|---|---|---|---|---|---|---|---|
| AF22 | 19 | ±47 | 1.34 | 1.40 | 1.04 | | X | X |
| AF23 | 22 | ±27 | 1.35 | 1.41 | 1.04 | | Δ | Δ |
| AF24 | 25 | ±12 | 1.35 | 1.40 | 1.04 | | | |
| AF25 | 27.5 | ±2 | 1.38 | 1.45 | 1.05 | | | |

Comparative Example 1

Two kinds of artificial furs same as AF4 obtained in Example 1 were produced and, however, one of them (AF-26) was not sprayed with a softening agent and the other (AF-27) was pressed against a rotary hot roll having a surface temperature of 180° C., whereby the piles were heat-set as they were laid down in the contrary direction to the fur travelling direction. Comparison of those with AF4 is given in Table 8 below.

TABLE 8

| Art. fur No. | Frictional coefficient: Right direction ($M_1$) | Frictional coefficient: Adverse direction ($M_2$) | Frictional coefficient: Coefficient ratio ($M_2/M_1$) | Hand: Softness | Hand: Hair loosening ability | Hand: Bulkiness | Remarks |
|---|---|---|---|---|---|---|---|
| AF26 | 1.78 | 1.84 | 1.03 | Δ | X | | Without softening treatment. |
| AF27 | 1.35 | 2.05 | 1.52 | | X | Δ | Heat-set as piles laid down in one direction |
| AF4 | 1.38 | 1.45 | 1.05 | | | | Present invention |

From the above result, it has been ascertained that the effect of the treatment with softening agent is contributory largely to frictional coefficient as well as hair loosening ability and that piles set as lying down in a constant direction cause an augmentation of anisotropicity of frictional coefficient.

EXAMPLE 6

A cut pile fabric was produced, using, as ground warp and weft yarns, a two-ply yarn made of the composite filamant yarns of 100 d/36 f having a cross-sectional configuration as shown in FIG. 19 which were used in Example 2, and as a pile yarn, a three-ply yarn made of the filament yarns of 75 d/60 f which were used in Example 1. Cut pile length was made to be 30 mm and piling density was 105 piles/cm$^2$. This cut pile fabric was soaked in 1% NaOH aqueous solution at 90° C. for 60 minutes to elute the PET copolymer component from composite filaments in the ground yarn, thereby thinning down individual filament to a super-fineness of 0.26 d. After washing with water, centrifugally hydroextracting and drying, the fabric was subjected to the centrifugal finishing treatment. In the treatment of the cut pile fabric with the same centrifugal finishing apparatus as employed in Example 1, the rotation speed was set to 370 rpm (a centrifugal force of about 75 G) and after heat-setting at 140° C., 18% NaOH aqueous solution, as a treating liquid, was fed up to an inside liquid level from substrate fabric of 25 mm, which was then gradually discharged with a level lowering speed of 1 mm per 5 minutes, until the liquid level from substrate fabric reached 30 mm, while the top end portion of pile yarns was treated. After discharging all the caustic solution rapidly, the pile fabric, as attached to the apparatus, was washed with water and dried. Then, rotating at the same speed as above, the container was filled up with a dyeing solution containing 0.5 g/l of Miketon TM Polyester Grey T (manufactured by Mitsui Toatsu Kagaku K.K.) and 3 g/l of a carrier so that the whole pile fabric could be steeped in, and dyeing was effected at 99° C. for 30 minutes. After discharging the dyeing solution, another dyeing solution containing 1.0 g/l of Miketon TM Polyester Black G (manufactured by Mitsui Toatsu Kagaku K.K.) and 3 g/l of a carrier was fed up to a level from substrate fabric of 14 mm and dyeing was effected at 99° C. for 45 minutes. After the dyeing solution had been discharged, and washed with water, a reduction washing (at 70° C. for 20 minutes), washing with water and drying were successively carried out. Then, dimethylformamide was fed up to a level from substrate fabric of 23 mm, to decolorize the top portion of piles by treating them for 15 minutes. After washing it with water and drying, the fabric was detached from the centrifugal finishing machine. By the above-described dyeing and decolorizing method, the piles had a root colored in grey, a middle portion in black, and a top end portion in slightly greyish white, which exhibited three-dimensional fancy appearances and favorable color variations.

A treatment of the substrate fabric and a finishing were performed in the same manner as Example 1, to obtain artificial fur AF28. This artificial fur was very soft and exhibited a stiffness of 24 mm in the warp direction and 20 mm in the weft direction.

EXAMPLE 7

PET having a molecular weight of 15,000 and containing 1.2% of titanium dioxide (dulling agent) was melt-spun to produce drawn filament yarn $SF_1$ of 30 d/2 f having a cross-section as shown in FIG. 9. Additionally, the same PET was melt-spun to produce two types of drawn filament yarns $WF_2$ and $WF_3$ *l respectively of* 75 d/72 f and 75 d/36 f, having a circular cross-section. A crimp of about 8% crimp ratio was provided to those drawn filament yarns $WF_2$ and $WF_3$ by Banlon ® process. One end of yarn $SF_1$ for guard hairs was blended respectively with three ends of yarns $WF_1$ and $WF_2$ for underhairs, and the respective blend yarns were twisted into yarns $PF_1$ and $PF_2$ each having a twist of 100 T/M.

Cut pile fabrics CP13 and CP14 were woven on a double-pile loom, using, as warp and weft yarns (ground yarns), 40 count two-ply yarn $GF_1$ which consisted of a blend of 70% of crimped PET staples of 1.5 d, having a cut length of 38 mm, and 30% of crimped nylon-6 staples of 2.5 d, having a cut length of 45 mm, and using yarns $PF_1$ and $PF_2$ respectively as pile yarn. Piles were cut into a pile length of 32 mm and piled in W-type with a piling density of 70 piles/cm$^2$.

After soaking in an aqueous emulsion of 15% benzylalcohol for 15 minutes followed by squeezing, fabrics CP13 and CP14 were treated with saturated steam at 95° C. for 20 minutes to effect shrinking of substrate fabrics. The shrink ratios of substrate fabrics were 22% in the warp direction and 25% in the weft direction respectively, and the areal shrink ratio was 42%.

The above-treated fabrics CP13 and CP14 were respectively finished in accordance with the process disclosed by the present inventors in U.S. Pat. No. 4,459,128 wherein a centrifugal force was utilized. Namely, the respective fabrics CP13 and CP14 were finished by rotating the fabric fixed on a rotary cylinder having a diameter of 1 m to raise piles owing to centrifugal force and feeding a treating liquid into an outer container (outer cylinder) having a diameter of 1.1 m, rotating coaxially at the same speed with said rotary cylinder. At the outset, the pile fabric was heat-set at a temperature of 170° C. with a rotation speed of 300 rpm (a centrifugal force of about 50 G), then as a treating liquid, 18% NaOH aqueous solution at 97° C. was fed up to an inside liquid level from substrate fabric of 25 mm and keeping this liquid level, the fabric was treated for 25 minutes to cut its underhairs. Then, the treating liquid was discharged until the liquid level from substrate fabric reached 27 mm, then the liquid was further discharged slowly with a level lowering rate of 1 mm per 10 minutes, while the top end portion of the guard hairs was attenuated and eventually cut into a length of 30 mm. After discharging all the caustic solution rapidly, the thus alkali weight-reduction treated fabrics CP13 and CP14 were washed with water, dried and taken out of the centrifugal finishing machine.

For finishing, an aqueous emulsion of polyurethane elastomer (prepolymer) was applied by means of spraying upon the back of the substrate fabric; a softening agent, SOFBON TM ST-212/SOFBON TM ST-206=50/50 (manufactured by Takemoto Yushi K.K.) was applied by means of spraying upon the piles with an add-on amount as pure ingredient of 0.5%; then the fabric were subjected to a dry heat-treatment at 180° C. to cure those resins, followed by drying; and thus artificial furs AF29 and AF30 were obtained. An artificial fur manufactured in accordance with the same process as that for AF30, except only that the guard hair attenuation treatment was omitted, was denoted as AF31. Their structure and properties are shown in Table 9 below.

TABLE 9

| Art. fur No. | AF29 | AF30 | AF31 | AF32 | AF33 | AF34 |
|---|---|---|---|---|---|---|
| Underhair: | 75/72//3 | 75/36//3 | 75/36//3 | 75/288//3 | 75/16//3 | 75/36//3 |
| Fineness of single filament (d) | 1.04 | 2.08 | 2.08 | 0.26 | 4.69 | 2.08 |
| Length (mm) | 25 | 25 | 25 | 25 | 25 | 25 |
| Hair density (hairs/cm$^2$) | 26,070 | 13,035 | 13,035 | 104,275 | 5,793 | 13,035 |
| Guard hair: | 30/2 | 30/2 | 30/2 | 30/2 | 30/2 | 30/2 |
| Fineness of single filament (d) | 15 | 15 | 15 | 15 | 15 | 15 |
| Length (mm) | 30 | 30 | 30 | 30 | 30 | 30 |
| Hair density (hairs/cm$^2$) | 241 | 241 | 241 | 241 | 241 | 241 |
| Weight ratio in piles (wt. %) | 13.0 | 13.0 | 13.8 | 13.0 | 13.0 | 13.0 |
| Frictional coefficient: | | | | | | |
| Right direction ($M_1$) | 1.22 | 1.27 | 1.51 | 1.43 | 1.39 | 1.18 |
| Adverse direction ($M_2$) | 1.29 | 1.39 | 1.69 | 1.64 | 1.60 | 2.23 |
| $M_2/M_1$ ratio | 1.06 | 1.09 | 1.12 | 1.15 | 1.15 | 1.89 |
| Hand: | | | | | | |
| Softness | | | Δ | | X | |
| Bulkiness | | | | X | | X |
| Hair-loosening | | | | X | | X |
| Remarks | | | | | | Piles lie in the same direction |

Note:
Very good, Good, Δ A little inferior, X Inferior

Comparative Example 2

For a comparative purpose, the following three kinds of artificial furs were prepared.

(1) Using a copolymer of PET with 18% of PEG having a molecular weight of 600, which copolymer having a molecular weight of 17,000 and containing no titanium dioxide, and the same PET as used for $SF_1$, a conjugate-spinning was carried out to obtain a drawn composite filament yarn $WF_4$ of 100 d/36 f, having a cross-section as shown in FIG. 19. In FIG. 19, numeral 15 denotes PET copolymer and numeral 16 PET, and the areal ratio of PET copolymer to PET is 1 to 3. This yarn $WF_4$ was used as underhairs and treated in the same manner as that in Example 7, except that prior to the cutting of the underhairs in the centrifugal finishing process, the cut pile fabric was soaked in 1% NaOH aqueous solution at 90° C. for 60 minutes. to elute PET copolymer component from the composite filaments, thereby thinning down the filaments, then washed with water and dried. Then the fabric was similarly finished to provide artificial fur AF32.

(2) Using the same PET as used for $SF_1$, drawn filament yarn $WF_5$ of 75 d/16 f having a circular cross-section, was produced. This yarn was used for underhairs and treated in the same manner as in Example 7 to provide artificial fur AF33.

(3) Fur AF30 obtained in Example 7 was inserted into a nip of paired hot rolls to heat-set piles as they were laid down in the contrary direction to the fur travelling direction and the thus obtained fur was denoted as AF34. The structure and properties of these furs are also shown in Table 9 above. It has been found that underhairs of 0.26 d is too thin, while 4.69 d is too thick, and the guard hair tip attenuation treatment serves to reduce frictional coefficient. Further, fur AF34 demonstrates that setting of piles as lying down in one direction causes an augmentation of anisotropicity of frictional coefficient.

EXAMPLE 8

Figure 8:
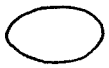

PET having a molecular weight of 17,000 and containing 1.2% of titanium dioxide was melt-spun to produce a drawn filament yarn $SF_2$ of 30 d/f2 having a cross-section as shown in FIG. 8. Additionally, the same PET was melt-spun to produce another drawn filament yarn $WF_6$ of 75 d/60 f, having a circular cross-section, which was subjected to the Banlon® crimping process to provide a crimp of 8% crimp ratio. One end of yarn $SF_2$ for guard hairs was blended with two ends of yarn $WF_6$ for underhairs, and the blend was twisted into yarn $PF_3$ having a twist of 100 T/M.

Two ends of yarn $WF_2$ (75 d/72 f) used in Example 7 were piled and twisted into a yarn having a first twist of 800 T/M/Z and a second twist of 600 T/M/S which was used as a ground yarn $GF_2$, and then using the abovementioned yarn $PF_3$ for a pile yarn, cut pile fabric CP15 was woven on a double-pile loom. The piles having a cut pile length of 27 mm were piled in W-type with a piling density of 160 piles/cm$^2$.

AF37 which were prepared by varying attenuation conditions and cut length; artificial furs AF38–42 prepared by using yarns of 30 d/1 f ($SF_3$), 50 d/1 f ($SF_4$), 30 d/10 f ($SF_5$), 100 d/20 f ($SF_6$) and 40 d/1 f ($SF_7$) respectively in place of the yarn $SF_2$ for guard yarns and in the same manner as that in Example 8; and artificial fur AF43 prepared without using any guard hairs, their structure and properties together with those of artificial fur AF35 obtained in Example 8 are shown in Table 10 below.

When guard hairs are too much longer than underhairs as in AF37, the hand will become stiff. As for the fineness of a single filament of the guard hairs, if it is no less than 50 deniers as AF39, the hand will also become stiff, and on the other hand, if it is too thin as AF40, frictional coefficient will be excessively increased while the hair-loosening ability is impaired. Further, in the case where guard hair density is too high, the objective article according to the invention is also not obtainable in respect to softness and frictional coefficient. Furthermore, it is apparent from Table 10 that when no guard hairs exist, a hair-loosening ability inherent in the fur will be lost.

TABLE 10

| Art. fur No. | AF35 | AF36 | AF37 | AF38 | AF39 | AF40 | AF41 | AF42 | AF43 |
|---|---|---|---|---|---|---|---|---|---|
| Underhair: | 75/72//2 | 75/72//2 | 75/72//2 | 75/72//2 | 75/72//2 | 75/72//2 | 75/72//1 | 75/72//2 | 75/72//2 |
| Fineness of single filament (d) | 1.04 | 1.04 | 1.04 | 1.04 | 1.04 | 1.04 | 1.04 | 1.04 | 1.04 |
| Length (mm) | 15 | 15 | 15 | 15 | 15 | 15 | 15 | 15 | 15 |
| Hair density (hairs/cm$^2$) | 23,040 | 23,040 | 23,040 | 23,040 | 23,040 | 23,040 | 11,520 | 23,040 | 23,040 |
| Guard hair: | 30/2 | 30/2 | 30/2 | 30/1 | 50/1 | 30/10 | 100/20 | 40/1 | — |
| Fineness of single filament (d) | 15 | 15 | 15 | 30 | 50 | 3 | 5 | 40 | — |
| Length (mm) | 22 | 18 | 27 | 22 | 22 | 22 | 22 | 18 | — |
| Tapered length (mm) | 3 | 3 | 3 | 3 | 3 | 3 | 3 | 3 | — |
| Hair density (hairs/cm$^2$) | 320 | 320 | 320 | 160 | 160 | 1,600 | 3,200 | 160 | — |
| Weight above underhair layer (mg/cm$^2$) | 2.67 | 0.53 | 4.63 | 2.67 | 4.44 | 2.67 | 8.88 | 0.71 | — |
| Weight ratio in piles (%) | 21.1 | 17.6 | 30.0 | 21.1 | 30.8 | 21.1 | 64.0 | 22.1 | 0 |
| Frictional coefficient | | | | | | | | | |
| Right direction ($M_1$) | 1.25 | 1.40 | 1.28 | 1.26 | 1.18 | 1.65 | 1.48 | 1.20 | 2.08 |
| Adverse direction ($M_2$) | 1.29 | 1.47 | 1.41 | 1.48 | 1.34 | 1.80 | 1.66 | 1.40 | 2.25 |
| $M_2/M_1$ ratio | 1.03 | 1.05 | 1.10 | 1.17 | 1.14 | 1.09 | 1.12 | 1.12 | 1.08 |
| Hand: | | | | | | | | | |
| Softness | | | Δ | | X | | Δ | X | |
| Bulkiness | | | Δ | | | | Δ | Δ | |
| Hair-loosening ability | | | | | | X | | | X |

Cut pile fabric CP15 was fixed on the centrifugal finishing machine used in Example 7 and subjected to the same alkali treatment. Then, in the underhair cutting process, underhairs were cut by treating for 25 minutes with a treating liquid, 18% NaOH aqueous solution at 97° C. kept its inside liquid level from substrate fabric at 15 mm. Subsequently, the treating liquid was discharged until the liquid level from substrate reached 19 mm, then the liquid was further discharged slowly with a level lowering rate of 1 mm per 10 minutes, while the top end portion of guard hairs was gradually attenuated and eventually cut into a length from substrate fabric of 22 mm. Namely, the tapered length at the top end portion of guard hairs was 3 mm. After discharging all the treating liquid rapidly, the thus alkali weight-reduction treated fabric CP15 was washed with water, dried, taken out of the centrifugal finishing machine and thereafter subjected to the same resin finish as Example 7, to provide artificial fur AF35.

Comparative Example 3

For the purpose of comparing with artificial fur 35 obtained in Example 8, as to artificial furs AF36 and

EXAMPLE 9

Figure 13:
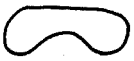
Figure 14:
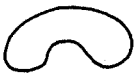
Figure 15:
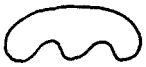
Figure 16:
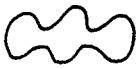

PET having a molecular weight of 17,000 and containing 1.2% of titanium dioxide (dulling agent) was melt-spun to produce a drawn filament yarn $SF_8$ of 40 d/3 having a cross-section as shown in FIG. 13. Additionally, the same PET was melt-spun to produce another drawn filament yarn $WF_7$ of 75 d/60 f (fineness of individual filament of 1.25 d), having a circular cross-section, which was subjected to a crimping process by using a two heaters type false-twister. The rotation number of the spinner was 340,000 rpm, yarn delivery speed was 100 m/min. (twisting number of 3,400 T/M), the first heater was of a contact type, 1.2 m long, and the second heater was of a non-contact type and 90 cm long. By varying the temperatures of the first and second heaters, various false-twisted filament yarns $WF_8$–$WF_{10}$ which were different in crimp ratio were obtained. Their process conditions and crimp ratio are given in Table 11 below.

TABLE 11

| Yarn No. | 1st heater temperature (°C.) | 1st feed rate (%) | 2nd heater temperature (°C.) | 2nd feed rate (%) | Crimp ratio (%) | Remarks |
|---|---|---|---|---|---|---|
| $WF_8$ | 170 | +2 | 210 | +2.5 | 6.5 | Present invention |
| $WF_9$ | 180 | +2 | 200 | +2.5 | 18.2 | Present invention |
| $WF_{10}$ | 200 | +2 | 200 | +2.5 | 35.0 | Comparative |

Three ends respectively of false-twisted filament yarns $WF_8 \sim WF_{10}$ were blended with one end of filament yarn $SF_8$ and the respective blend yarns were twisted into yarns $PF_4 \sim AF_6$ each having a twist of 100 T/M.

A 40 count two-ply yarn composed of mixed-spun yarns consisting of 70% of crimped PET staples of 1.5 d, having a cut length of 38 mm, and 30% of crimped nylon-6 staples of 2 d, having a cut length of 45 mm, was denoted as $GF_3$.

Using yarn $GF_3$ as warp and weft (ground) yarns and yarns $PF_4 \sim PF_6$ as pile yarns respectively, cut pile fabrics CP16~CP18 were woven on a double-pile loom. Piles having a cut pile length of 32 mm were piled in W-type with a piling density of 70 piles/cm$^2$.

After soaking in an aqueous emulsion of 15% benzylalcohol for 15 minutes followed by squeezing, fabrics CP16~CP18 were treated with saturated steam at 95° C. for 20 minutes to effect shrinkage of the substrate fabrics. The shrink ratios of the substrate fabrics were 20% in the warp direction and 25% in the weft direction respectively, and the areal shrink ratio was 40%. As a result of the shrinking, the hair density of underhairs became about 21,000 hairs/cm$^2$ and that of the guard hairs about 350 hairs/cm$^2$.

The above shrunk pile fabrics CP16~CP18 were subjected to a similar centrifugal finishing process.

The pile fabrics were heat-set at 170° C. with a rotation speed of 600 rpm (a centrifugal force of about 200 G), then as a treating liquid, 15% NaOH aqueous solution at 97° C. was fed up to an inside liquid level from substrate fabric of 23 mm and keeping this liquid level, the fabrics were treated for 30 minutes to cut their underhairs. Then, the treating liquid was discharged until the liquid level from substrate fabric reached 25 mm, then the liquid was further discharged slowly with a level lowering rate of 1 mm per 10 minutes, while the top end portion of guard hairs was gradually attenuated and eventually cut into a length from substrate fabric of 28 mm. After discharging all the caustic solution rapidly, the thus alkali weight-reduction treated fabrics CP16~CP18, as attached to the cylinder, were washed with water and dried. Then, rotating at the same speed as the above, the container was filled up with a dyeing solution containing 0.5 g/l of Miketon TM Polyester Grey T (manufactured by Mitsui Toatsu Kagaku K.K.) and 2 g/l of a carrier so that the whole pile fabric could be steeped in, and dyeing was effected at 99° C. for 30 minutes. After discharging the dyeing solution, another dyeing solution containing 1.0 g/l of Miketon TM Polyester Black G (manufactured by Mitsui Toatsu Kagaku K.K.) and 3 g/l of a carrier was fed up to a level from substrate fabric of 14 mm wherein dyeing was effected at 99° C. for 45 minutes, and then washing with water, a reduction washing (at 70° C. for 20 minutes), washing with water and drying were successively carried out. Then, dimethylformamide was fed up to a level from substrate fabric of 23 mm wherein piles were treated for 15 minutes, and after washing with water and drying, the fabrics were taken out of the centrifugal finishing machine. By the above-described dyeing and decolorizing, the underhairs had a root colored in grey and top portion in black, and the guard hairs had a root colored in grey, middle portion in black and a top end portion in slightly greyish white. For finishing, an aqueous emulsion of polyurethane elastomer (prepolymer) was applied by means of spraying upon the back of the substrate fabrics; as a lubricating agent, a perfluoroalkylic water- and oil-repellent, stainproof agent, i.e. SURFLON# SC 105 (manufactured by Asahi Glass K.K.), was applied by means of spraying upon the piles; and a dry heat-treatment at 180° C. was performed, to obtain artificial furs AF44~AF46. Additionally, cut pile fabric CP16 was treated in the same manner except that the water- and oil-repellent treatment was omitted, to obtain artificial fur AF47. Their structure and properties are given in Table 12 below.

It is apparent from Table 12 that the crimp ratio of underhairs should be controlled within 20% and that the effect on frictional coefficient of the lubricating agent is prominent.

TABLE 12

| Art. fur No. | AF44 | AF45 | AF46 | AF47 |
|---|---|---|---|---|
| Underhair: | 75/60//3 | 75/60//3 | 75/60//3 | 75/60//3 |
| Fineness of single filament (d) | 1.25 | 1.25 | 1.25 | 1.25 |
| Crimp ratio (%) | 6.5 | 18.2 | 35.0 | 6.5 |
| Length (mm) | 23 | 23 | 23 | 23 |
| Hair density (hairs/cm$^2$) | 21,000 | 21,000 | 21,000 | 21,000 |
| Guard Hair: | 40/3 | 40/3 | 40/3 | 40/3 |
| Fineness of single filament (d) | 13.3 | 13.3 | 13.3 | 13.3 |
| Length (mm) | 28 | 28 | 28 | 28 |
| Hair density (hairs/cm$^2$) | 350 | 350 | 350 | 350 |
| Water- and Oil-repellent | treated | treated | treated | not treated |
| Frictional Coefficient: | | | | |
| Right direction ($M_1$) | 1.15 | 1.40 | 1.89 | 2.44 |
| Adverse direction ($M_2$) | 1.23 | 1.58 | 2.01 | 2.68 |
| $M_2/M_1$ ratio | 1.07 | 1.13 | 1.06 | 1.10 |
| Hand: | | | | |
| Softness | | | Δ | |
| Bulkiness | | | | |
| Hair-loosening ability | | | X | X |

EXAMPLE 10

Using pile yarn $PF_1$ prepared in Example 7, the following cut pile fabrics were produced. Yarn used as the ground yarn in each case was as follows.

(1) Using, as warp and weft (ground) yarns, a 40 count two-ply yarn $GF_4$ composed of mixed-spun yarns consisting of 70% of crimped PET staples of 3 d, having a cut length of 45 mm, and 30% of crimped nylon-6 staples of 4 d, having a cut length of 45 mm, a cut pile fabric was produced which was denoted as CP19.

(2) A cut pile fabric produced by using, as warp and weft (ground) yarns, a two-ply yarn $GF_5$ composed of composite filament yarns $WF_4$ of 100 d/36 f having a cross-section as shown in FIG. 19 which were used in Comparative Example 2, was denoted as CP20.

Of both of those fabrics, the piles having a cut pile length of 32 mm were piled in W-type with a piling density of 70 piles/cm$^2$.

Fabrics CP19 and CP18 were shrunk with benzylalcohol in the same manner as Example 7. Then, only fabric CP20 was soaked in 1% NaOH aqueous solution at 90° C. for 60 minutes to elute PET copolymer component from composite filaments in the ground yarn, thereby thinning down the filaments into a single filament fineness of 0.26 denier.

These fabrics CP19 and CP20 were subjected to a centrifugal finishing treatment in the same manner as Example 7, and produced artificial furs AF48 and AF49. Their properties are shown in Table 13, together with those of artificial fur AF29.

TABLE 13

| Art. fur No. | AF48 | AF49 | AF29 |
|---|---|---|---|
| Ground yarns (Warp and Weft) | 40 count 2-ply, PET 3d:70% 6N 4d:30% | 75/288//2 | 40 count 2-ply, PET 1.5d:70% 6N 2.5d:30% |
| Shrinkage with benzylalcohol % | 43 | 25 | 42 |
| Stiffness of substrate | | | |
| Warp | 71 | 21 | 42 |
| Weft | 63 | 20 | 39 |

As described above, according to the present invention, by selecting and synthetically combining fineness, length, density, frictional coefficient and color of piles, properties of substrate fabric, etc., can be obtained artificial furs matching or even surpassing a natural fur of the highest quality, chinchilla, in aesthetic properties, which have so far been considered nearly impossible.

While there has been shown and described what are considered the preferred embodiments of the invention, it will be obvious to those skilled in the art that various alteration, modifications and applications may be made therein without departing from the scope of the invention as defined by the appended claims.

What is claimed is:

1. A chinchilla-like artificial fur comprising a substrate fabric and pile fibers secured to at least one side of said fabric and projecting therefrom, in which (a) said pile fibers comprise underhairs having a fineness in the range of from 0.5 to less than 4.0 deniers, an average length in the range of from 10 to 35 mm, a hair density in the range of from 8,000 to 30,000 hairs/cm$^2$ and a crimp ratio of 20% or less, (b) said pile fibers have a minimum frictional coefficient ($M_1$) of 1.6 or less and ($M_1$) is measured in a first direction in which said pile fibers are inclined, and (c) the ratio ($M_2/M_1$) is the range of from 1.0 to 1.4, wherein $M_2$ is the frictional coefficient in a second direction which lies at an angle of 180° to said first direction.

2. An artificial fur as claimed in claim 1, wherein said pile fibers comprise polyester fibers containing a lubricating agent or having a resinous lubricating membrane on the surfaces thereof.

3. An artificial fur as claimed in claim 1, wherein 70% or more of the number of said underhairs in any square region measuring 1 cm wide and 1 cm long of said substrate fabric have a length of ±30% of the average length of said pile fibers, over at least 60% of the surface area of said substrate fabric.

4. An artificial fur as claimed in claim 1, wherein the frictional coefficient in said first direction is 1.4 or less and said ratio ($M_2/M_1$) is in the range of from 1 to 1.2.

5. An artificial fur as claimed in claim 1, wherein the portions of said pile fibers remote from said substrate fabric are different in color from the portions of said pile fibers adjacent to said substrate fabric.

6. An artificial fur as claimed in claim 1, wherein said pile fibers each have an attenuated outer end portion remote from said substrate fabric.

7. An artificial fur as claimed in claim 1, wherein said substrate fabric comprises a yarn consisting of individual filaments of 1.5 deniers or less and said substrate fabric has a stiffness both in the warp and weft directions of 60 mm or less.

8. An artificial fur as claimed in claim 1, wherein said pile fibers further comprise guard hairs having a fineness in the range of from 4 to 50 deniers and a hair density of 3,000 hairs/cm$^2$ or less.

9. An artificial fur as claimed in claim 8, wherein the difference in the average lengths of said guard hairs and said underhairs is in the range of from 0 to 7 mm.

10. An artificial fur as claimed in claim 8, wherein the weight ratio of said guard hairs to said pile fibers Rg (weight %) and the fineness of individual guard hairs Dg (denier) satisfy the following inequalities (I) and (II)

$$\frac{1}{36} Dg + 3\frac{1}{9} \leqq Rg \leqq -\frac{7}{18} Dg + 34\frac{5}{9} \quad \text{(I)}$$

$$4 \leqq Dg \leqq 40 \ldots \quad \text{(II).}$$

11. An artificial fur as claimed in claim 8, wherein the weight per unit area of parts of said guard hairs exposed above said underhairs is in the range of from 0 to 20 mg/cm$^2$.

12. An artificial fur as claimed in claim 11, wherein said weight per unit area is between 0.2 and 10 mg/cm$^2$.

13. An chinchilla-like artificial fur, comprising:

a substrate fabric weighing from 50 to 150 g/square meter, made of yarn consisting essentially of filaments of 1.5 deniers or less and having a stiffness in both the warp and weft directions of 40 mm or less;

a multiplicity of pile fibers projecting upwardly from the surface of said substrate fabric, said pile fibers consisting essentially of (1) a multitude of underhairs having a fineness of from 0.9 to 2.5 deniers, an average length of from 15 to 25 mm, a hair density of from 12,000 to 20,000 hairs/cm$^2$ and a crimp ratio of from 0.5 to 5%, at least 70% of the number of said underhairs having lengths within ±30% of the average length of all of said underhairs, and (2) a multitude of guard hairs which are thicker and longer than said underhairs, said guard hairs having a fineness of from 8 to 20 denier and a hair density of from 50 to 1,000 hairs/cm$^2$, the weight ratio of guard hairs to the total of said pile fibers and the fineness of said guard hairs lying on or within the closed quadrilateral area defined by lines connecting the points P, Q, R and S in alphabetical order, wherein the points P, Q, R and S are defined on an XY rectangular coordinate system by the following values

| Point | X Axis Fineness of Single Guard Hair | Y Axis Guard Hair Ratio |
|---|---|---|
| P | 20 | 8 |
| Q | 20 | 20 |
| R | 8 | 23 |
| S | 8 | 9, |

the average length of said guard hairs being from 1 to 6 mm longer than the average length of said underhairs, the weight, per unit area of said substrate, of the parts of said guard hairs that extend above said underhairs being from 0.2 to 10 mg/cm$^2$, said guard hairs being free from crimps, said pile fibers exhibiting a low anisotropy, said pile fibers having a minimum friction coefficient ($M_1$) of 1.2 or less measured in a first direction in which said pile fibers are inclined and having a second friction coefficient ($M_2$) measured in a second direction which extends at an angle of 180° to said first direction, and the ratio of $M_2/M_1$ is from 1/1 to 1.2/1.

14. A chinchilla-like artificial fur as claimed in claim 13 in which the outer end portions of said underhairs are of reduced diameter, said outer end portions having a length of from 0.5 to 3 mm and being remote from said substrate.

* * * * *